United States Patent [19]

Greenlee et al.

[11] 4,265,459

[45] May 5, 1981

[54] SWAB CUP REINFORCING MEMBER SUPPORT

[75] Inventors: Donald R. Greenlee; Bill J. Hyde, both of Dallas, Tex.

[73] Assignee: Dresser Industries, Inc., Dallas, Tex.

[21] Appl. No.: 36,970

[22] Filed: May 8, 1979

[51] Int. Cl.[3] ..... F16J 15/56; F16J 9/00

[52] U.S. Cl. ..... 277/212 C; 92/241; 277/31

[58] Field of Search ..... 277/149, 31, 152, 164, 277/165, 212 R, 212 C, 235 R; 92/241, 254; 166/173, 176

[56] References Cited

U.S. PATENT DOCUMENTS

| | | | |
|---|---|---|---|
| 2,305,282 | 12/1942 | Taylor et al. | 92/241 |
| 2,518,257 | 8/1950 | Bowerman | 92/241 X |
| 2,723,721 | 11/1955 | Corsette | 277/212 C X |
| 2,917,352 | 12/1959 | Taylor | 92/241 |
| 3,398,654 | 8/1968 | Waldrop | 277/212 C X |

*Primary Examiner*—Robert S. Ward, Jr.

*Attorney, Agent, or Firm*—J. N. Hazelwood; W. R. Peoples

[57] ABSTRACT

A well swab cup has an annular bushing for supporting a plurality of longitudinally extending reinforcing members within an elastomeric cup like body. The reinforcing members are supported around the periphery of the bushing and extend upward to a mid-portion of the body. A reinforcing member position support assembly is located above the bushing within the body to locate and position the reinforcing members in a spaced relation to each other around the swab cup.

7 Claims, 3 Drawing Figures

SWAB CUP REINFORCING MEMBER SUPPORT

TECHNICAL FIELD

This invention is related to well swab cup internal constructions. More specifically, the invention is related to swab cup internal constructions which are adapted to position and support the swab cup reinforcing members or wires within the elastomeric cup like body.

BACKGROUND OF THE INVENTION

In the manufacture of well swab cups, the cage consisting of the bushing and the wires or support members is formed of separate parts then assembled into a skeletal like configuration. Once this is done, the cage is placed in a mold cavity and the mold cavity is filled with an elastomeric compound to complete the molding process. Because of the relatively large quantity of swab cups that are manufactured, the bushing is constructed so the wires can be easily slipped into place in the mounting portion of the bushing. In order to assure ease in assembly, apertures through the bushing which support the wires are substantially larger than the normal or typical wires to allow for rapid assembly. Because of this loose fit, wires which are only supported by a single mount or contact with the bushing tend to become displaced during the molding process from a regularly spaced arrangement around the bushing to an irregular arrangement that may have a substantial gap between certain of the wires while others are substantially closer together than may be desirable.

When a swab cup is made with an excessively large gap between some of the wires while the others are abnormally close together, this will create a weakened sidewall of the cup body. This weakened wall portion will cause the cup to blowout or become peforated through a portion of the cup sidewall at the large gap thus destroying the swab cup.

Prior art swab cup constructions have overcome this problem of maintaining this spaced relation of the wires during molding by rigidly clamping the lower ends of the wires. This solution will overcome the problem of positioning the wires, however, it makes the lower portion of the swab cup extremely rigid; therefore, it is not a feasible solution for swab cups which must flex radially a significant amount in their lower as well as in their upper portions.

SUMMARY OF THE INVENTION

In an embodiment, a swab cup structure includes an elastomeric cup like body containing a bushing in its lower end portion with a plurality of wires or reinforcing members mounted around the bushing, and a support member or guide above the bushing to position the wires in a uniformed spaced relation around the periphery of the swab cup. The bushing is provided with a plurality of apertures around the outer periphery of its lower portion in which are mounted the lower ends of the U-shaped wires. These wires are located in a uniformly spaced relation around the periphery of the bushing and extend upward to a longitudinal mid-portion of the swab cup. The support member or wire guide is positioned above the bushing and has a plurality of spaced recesses to engage and support the mid-portion of the wires in order to prevent the wires from tipping or being longitudinally angularly displaced around the swab cup periphery from their uniformly oriented location around the bushing.

One object of this invention is to provide a swab cup structure overcoming the aforementioned disadvantages of the prior art devices in alignment and permanent positioning of the support members or wires.

Still, another object of this invention is to provide a swab cup structure which has a bushing to mount the reinforcing members or wires and an additional member to position the wires in a spaced relation around the circumference of the swab cup for maintaining the wires in this location during molding of the swab cup body.

Various other objects, advantages and features of this invention will become apparent to those skilled in the art from the following discussion, taken in conjunction with the accompanying drawing, in which:

Figure 1:
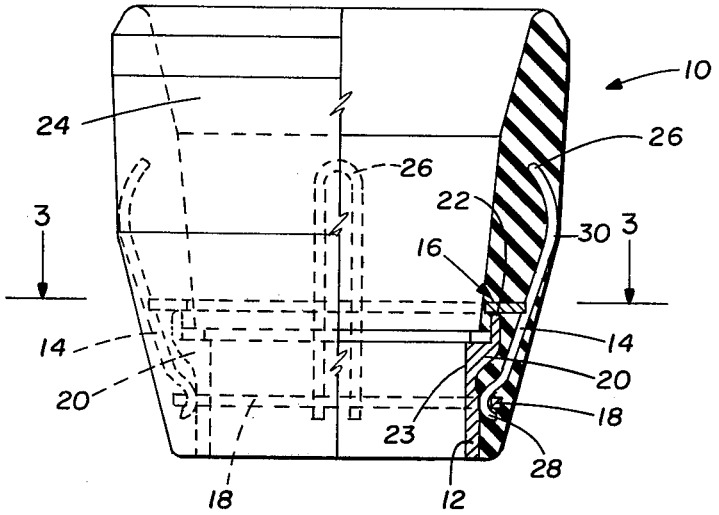
FIG. 1 is a side elevation view of a swab cup constructed in accordance with this invention and having a quarter section thereof cutaway for clarity and with some wires thereof shown in phantom lines.

The following is a discussion and description of preferred specific embodiments of the swab cup structure of this invention. Such being made with reference to the drawing, whereupon the same reference numerals are used to indicate the same or similar parts and/or structure. It is to be understood that such discussion and description is not to unduly limit the scope of the invention.

DETAILED DESCRIPTION

Referring to the drawings in detail and in particular to FIG. 1, a well swab cup 10 is shown with a section thereof cutaway exposing the bushing 12, the reinforcing members or wires 14 and the annular support or wire guide, indicated generally at 16. Swab cup 10 is a flexible cup shaped member with an opening through the bottom thereof to permit mounting on a mandrel with the flexible upper portion of the cup being upwardly directed.

Bushing 12 is an elevated hollow member which makes the lower portion of the swab cup relatively rigid and mounts the lower end portions of the reinforcing members or wires. Bushing 12 has a lower lip 18 around the outer periphery of the lower portion thereof. Lower lip 18 is provided with a plurality of spaced apertures therethrough for receiving the lower end portions of wires 14 and interlocking or interfitting with them. The upper portion of bushing 12 has an upwardly and radially outwardly disposed upper lip 20 which is located radially inward of wires 14 relative to the longitudinal axis of swab cup 10. The top of bushing 12 is an annular upwardly facing surface 22. Bushing 12 has an internal bore 23 defining its interior.

Figure 3:
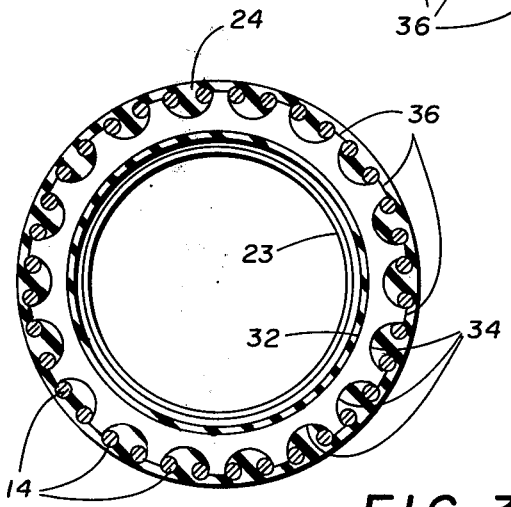
FIG. 3 is a transverse sectional view of the swab cup taken at the location of line 3—3 in FIG. 1.

Wires 14 are reinforcing members for the flexible swab cup body 24 and they are connected to bushing 12 for support at their lower end. Specifically, wires 14 of this swab cup are generally U-shaped members with the closed end portion of the U indicated at 26 and being on the upper end thereof. Wires 14 have their lower end portions 28 bent in curved fashion about an imaginary radius pivot point external to the swab cup so they will interlock with the apertures in bushing lower lip 18. Wires 14 each have their mid-portion 30 curved oppositely to their lower portion 28 and positioned well within the mid-portion of swab cup body 24. As can be seen in FIG. 3, the wires are positioned in a spaced relation around the periphery of bushing 12 in order to provide a uniformed support of resilient swab cup body 24.

Figure 2:
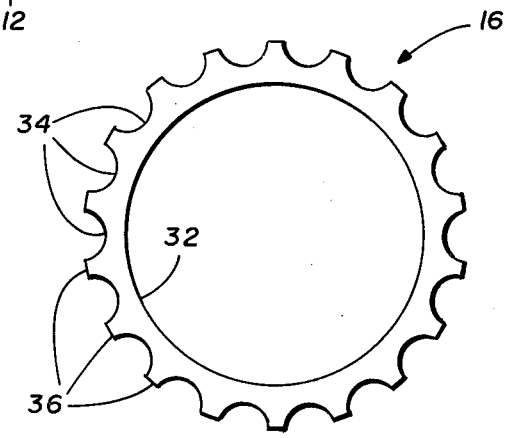
FIG. 2 is a plan view of the annular support member or wire guide alone.

The annular support or wire guide 16 is positioned above bushing 12 adjacent to bushing top 22. As shown in FIG. 2, annular support member 16 is a ring like member having a circular internal opening 32 and a plurality of recesses 34 at spaced intervals around the outer periphery thereof. Recesses 34 are spaced apart by partially circular segments 36 of the support member's periphery. Recesses 34 are shown as partially circular or somewhat broadly U-shaped recesses in the outer peripheral portion of the member. Recesses 34 are sufficiently broad enough around the support member perimeter to accommodate both sides of a single U-shaped wire 14. The recesses are also of a sufficient depth to accommodate at least a significant portion of the wire within the recess.

When the swab cup 10 is being assembled, the cage or internal components thereof are assembled first. Initially, the wires are positioned with their lower end portions 28 within the apertures of bushing lower lip 18. Annular support or wire guide 16 is positioned on bushing 12 at its top 22 and wires 14 are positioned within recesses 34 and aligned with the longitudinal axis of the wires in alignment with the longitudinal axis of the swab cup. Once this has been done, an endless and thin band of elastic or elastomeric material can be positioned around the outer periphery of wires 14 in a circumferentially stretched condition so as to exert a radially inwardly directed force on the wires through their mid-portion 30 in order to retain their position during handling and before the actual molding occurs. During the molding of swab cup body 24, the cage is placed in a mold cavity with the band in place. As the elastomeric material is injected into the mold, the band stays in place and assists in positioning wires 14 within recesses 34 of wire guide or annular support member 16. During this molding process, the material must flow around all surfaces of wires 14, annular support member 16 and around at least a portion of bushing 12. Because of recesses 34 in annular support member 16, wires 14 are not significantly displaced by the motion of this material flowing within the cavity of the mold around the components of the swab cup. So as a result, the wires remain essentially in the position which they assumed when the cage was assembled.

Because of annular support member 16, wires 14 are retained in a regular spaced relation around the periphery of swab cup 10 so that when the swab cup is put into use, the lower portion of the swab cup will support the fluid load in an evenly distributed fashion. This construction alleviates the above noted problems with the prior art structures wherein the load was not supported evenly around the lower periphery of the swab cup. The guide ring or annular support member of this invention provides a simple structure which provides for correctly holding the wires of a swab cup in their designed and preferred locations during the molding process of the swab cup. Because the annular support member retains the wires in this regularly spaced location arrangement around the periphery of the swab cup, it provides a positive assurance that the wires will be positioned for the maximum effectiveness of the swab cup.

The embodiments of the invention in which an exclusive property or privilege is claimed are defined as follows:

1. A well swab cup comprising:

(a) an annular bushing adapted to be disposed on a supporting mandrel, said bushing having a cup like elastomeric material body molded thereon and extending upward;

(b) said body including a plurality of circumferentially spaced longitudinally extending reinforcing members mounted with said bushing and extending upward in said body; and (c) a reinforcing member positioning support means having means adapted to be positioned above said bushing within said body to position said reinforcing members in a spaced relation to each other around the circumference of said swab cup and to support these reinforcing members in this spaced relation;

said support means having an annular member having a plurality of spaced recesses around and opening radially outwardly from the outer periphery thereof to receive said reinforcing members.

2. The swab cup of claim 1, wherein:

(a) said reinforcing members are generally U-shaped members having the closed end thereof upwardly positioned and the lower end portion thereof shaped to interfit with said bushing; and (b) said annular member has said recesses spaced apart such that both sides of any one of said wire members will fit within any one of said recesses.

3. In a well swab cup having a cup shaped body of resilient material containing an annular wire anchor bushing in a lower end portion of said body mounting a plurality of elongated and longitudinally curved cup body supporting wire members spaced apart around the perimeter thereof, an improvement comprising:

a wire positioning support means comprising an annular member having an opening at least as large in diameter as the opening of said annular wire anchor bushing and having a plurality of spaced apart recesses around the outer peripheral portion thereof arranged to position and retain said spaced apart wire members in their spaced apart relation, said recesses being spaced radially outwardly of said bushing and said annular member being positioned at the upper end portion of said wire anchor bushing.

4. The wire positioned support means of claim 3, wherein:

(a) said wire members being generally U-shaped members having the closed end thereof directed upward with the sides thereof spaced apart and the lower end portions thereof shaped to interfit with said wire anchor; and (b) said annular member having said recesses spaced apart such that both sides of one of said wire members will be positioned at least partially within one of said recesses.

5. The wire positioning support means of claim 4, wherein said recesses are generally broadly U-shaped with both sides of a support member positioned at and at least partially within said recesses and positioned to locate said support members in a uniform spaced relation to each other.

6. The wire positioning and support means of claim 4, wherein said annular member has said plurality of recesses formed by a plurality of partially circular indentations in the outer periphery of said annular member wherein said indentations are spaced apart by partially circular segments of the outer periphery of said annular member.

7. The wire positioning support means of claim 3 or 4 wherein said wire members each include a mid-portion slanted radially outwardly from said annular member upon progressing upwardly therefrom.

* * * * *